US005199807A

United States Patent [19]

Uchida

[11] Patent Number: 5,199,807

[45] Date of Patent: Apr. 6, 1993

[54] KNOCKING TYPE SOLID COSMETIC CONTAINER

[75] Inventor: Masaki Uchida, Gunma, Japan

[73] Assignee: Mitsubishi Pencil Co., Ltd., Japan

[21] Appl. No.: 729,656

[22] Filed: Jul. 15, 1991

[30] Foreign Application Priority Data

| | | | |
|---|---|---|---|
| Jul. 13, 1990 | [JP] | Japan | 2-74433[U] |
| Jul. 13, 1990 | [JP] | Japan | 2-74434[U] |
| Jul. 13, 1990 | [JP] | Japan | 2-74435[U] |
| Jan. 28, 1991 | [JP] | Japan | 3-7749[U] |

[51] Int. Cl.[5] ..... A45D 40/02; A45D 40/20

[52] U.S. Cl. ..... 401/65; 401/94; 401/171; 401/176

[58] Field of Search ..... 401/65, 76, 176, 179, 401/171, 182, 94

[56] References Cited

U.S. PATENT DOCUMENTS

| | | | |
|---|---|---|---|
| 2,637,466 | 5/1953 | Wright | 401/132 X |
| 3,108,687 | 10/1963 | Dayton, Jr. | 401/65 |
| 3,358,699 | 12/1967 | Bau | 401/76 X |
| 3,399,019 | 8/1968 | Koelichen | 401/134 |
| 3,687,561 | 8/1972 | Phillips | 401/134 |
| 3,947,133 | 3/1976 | Kageyama et al. | 401/65 X |
| 4,277,194 | 7/1981 | Smith | 401/182 X |
| 4,696,594 | 9/1987 | Powers | 401/65 |

FOREIGN PATENT DOCUMENTS

| | | | |
|---|---|---|---|
| 2117164 | 10/1972 | Fed. Rep. of Germany | 401/65 |

*Primary Examiner*—Steven A. Bratlie

*Attorney, Agent, or Firm*—James A. Wong

[57] ABSTRACT

A knocking type solid cosmetics container which comprises a container main body 1 comprising; a cylindrical pushrod housing pipe 6 inserted in the container main body 1; a delivery chuck 9 fixedly provided on a front end of the pushrod housing pipe 6, a pushrod 3 inserted into the pushrod housing pipe 6 and the delivery chuck 8; a tubular cartridge 2; and a piston 16 contained in the cartridge 2.

1 Claim, 5 Drawing Sheets

KNOCKING TYPE SOLID COSMETIC CONTAINER

BACKGROUND OF THE INVENTION

1. Field of the Invention

The present invention relates to a knocking type cosmetic container capable of delivering an lipstick, eyeliner, eyeshadow or the like stick type solid cosmetics.

2. Prior Art

Hithereto, in containers which deliverably contain stick type of solid comsetics, there have been employed screw delivery mechanisms as a delivery means.

In such conventional containers that have delivery means relying on the screw delivery mechanisms, since it is necessary to rotate some portion of the container to deliver the solid cosmetic for use, it is difficult to handle the container one-handed and thus both hands enevitably must be used.

Further, if the solid cosmetics are stored unused for a long time, there is also the problem that the cosmetics stick to the container so that delivery thereof is difficult in an ordinary delivery operation initially.

An object of the present invention is to provide a knocking type solid cosmetics container capable of delivery and operability of the more simple and convenient cosmetics merely through one hand knocking. Further, the present invention is aimed at providing a knocking type solid cosmetics container capable of smoothly delivering even such solid cosmetics that are stored unused for a long time.

SUMMARY OF THE INVENTION

According to the present invention, there can be provided a knocking type solid cosmetics container which comprises a tubular container main body consisting of a first shaft and a second shaft; a cylindrical pushrod housing pipe inserted in the container main body, a rear end thereof being projected out with a given length from the container main body; a delivery chuck fixedly provided on a front end of the pushrod housing pipe, a frontward outer periphery portion thereof being flared or trumpet-shaped and said delivery chuck being formed with wedge-shaped slits widening frontward; a pushrod inserted passing through into the pushrod housing pipe and the delivery chuck; a tubular cartridge having a pushrod holding member therein; and a piston contained axially movably in the cartridge and having a pushrod receiving portion.

The pushrod may be previously provided in the container main body or in the cartridge by arranging the length of the pushrod such that, when the container main body and the cartridge are connected, the pushrod may push the piston by a given distance as a result of such connection, the solid cosmetic can be easily delivered even if it has been stuck to the container.

The same effect can be achieved by an arrangement wherein a cap is mounted on a rear end of the pushrod housing pipe, a given idle space is left between a step portion of the cap and the rear end of the first tubular shaft, and a given idle space is left between the base portion of the piston and the front end of the pushrod respectively when unused, said space being designed longer than the space.

DETAILED DESCRIPTION AND THE PREFERRED EMBODIMENTS

Figure 1:
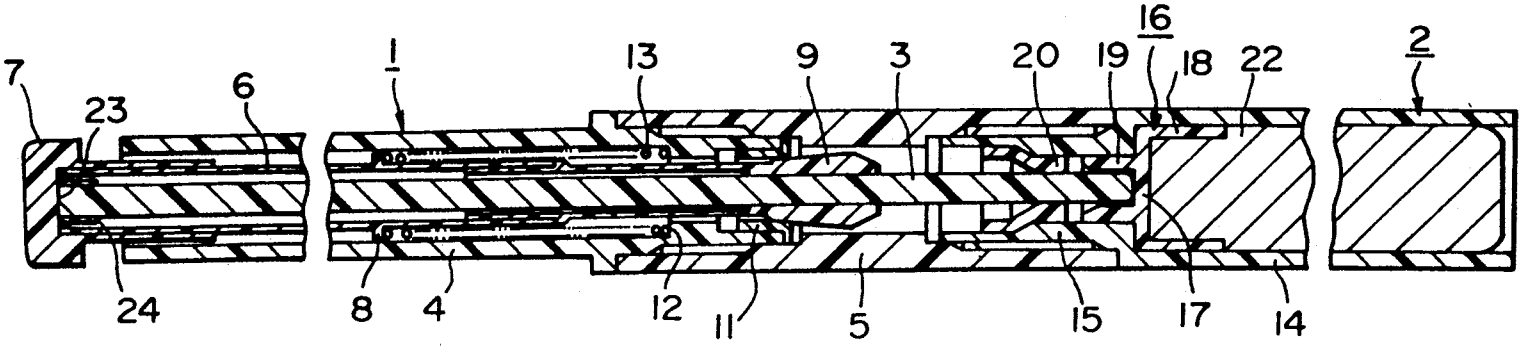
FIG. 1 illustrates a vertical section partially cut away of a lipstick container according to the present invention.
Figure 2:
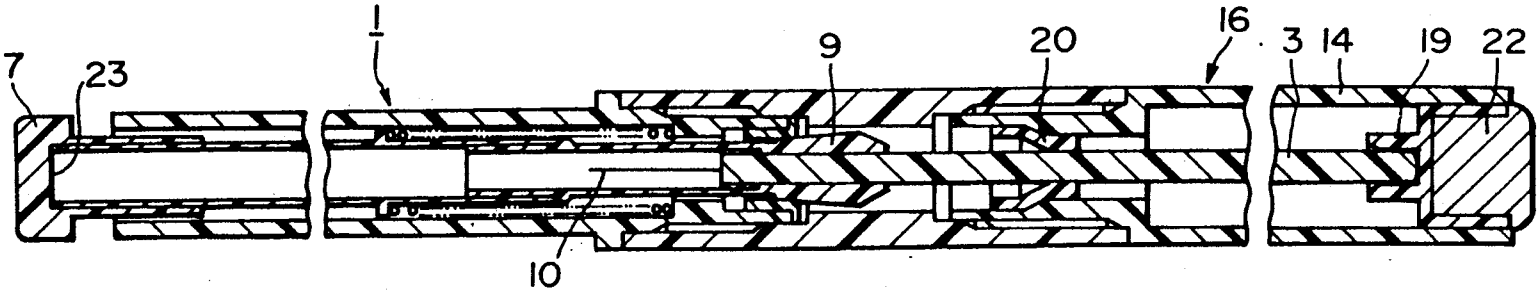
FIG. 2 illustrates a similar vertical section to FIG. 1, wherein a pushrod is already forward.

The present invention will now be described by way of several embodiments applied to lipstick containers.

Referring to FIGS. 1–4, there is illustrated a first embodiment. In these figures, the reference numeral 1 denote a container main body, 2 a cartridge and 3 a pushrod. In this embodiment, the pushrod 3 is previously mounted in the container main body 1.

The container main body 1 consists of a first tubular shaft 4 and a second tubular shaft 5 screwed on the front portion of the former.

In the container main body 1 is inserted a cylindrical pushrod housing pipe 6 having a shorter length than the container main body 1. The rear end of the pushrod housing pipe 6 projects out with a given length from the rear end of the container main body 1, and on the projecting end is put a cap 7 serving as a knocking member. Between the step portion of the cap 7 and the rear end of the container main body 1 is left a given space which accounts for one stroke of knocking motion of the pushrod housing pipe 6. On the outer wall of a central portion of the pushrod housing pipe 6 is provided a flanged spring seat 8.

On the front end of the pushrod housing pipe 6 is fixedly mounted a delivery chuck 9, which is cylindrical with its frontward outer side flared or trumpet-shaped. On the front end of the delivery chuck 9 are formed three wedge-shaped slits 10 widening toward the end.

Between the front end of the first shaft 4 and the delivery chuck 9 is provided a ring-shaped delivery chuck fastener 11, which has such inner diameter smaller than maximum outer diameter but larger than minimum outer diameter of the delivery chuck 9. The delivery chuck fastener 11 is axially slidable at a predetermined distance together with the delivery chuck 9.

On the inner wall of the front shaft 4 is provided a step 12 which serves as a spring seat at a place frontward to the spring seat 8 of the pushrod housing pipe 6, while between the spring seat 8 and the step 12 is provided a coil spring 13 surrounding the pushrod housing pipe 6. The coil spring 13 always urges rearward both the pushrod housing pipe 6 and the delivery chuck 9 fixed thereto with respect to the container main body 1.

In the through holes of the pushrod housing pipe 6 and the delivery chuck 9 is inserted the pushrod 3 whose rear end is first located at a rearmost position, namely a position at which the rear end of the pushrod 3 abuts against the cap 7.

A stopper 24 which may strike a pushrod holding member 20 is conveniently provided projectingly from the rear end of the pushrod 3, so that the pushrod 3 should not ultimately slip out of the container when it is pushed to the last extremity.

The cartridge 2 is cylindrical and has a large diameter portion 14 for containing a solid cosmetic 22 and a small diameter portion 15 for connection to a front portion of the container main body 1. A piston 16 is provided in the large diameter portion 14. The piston 16 is concentrically provided on one side of its base 17 with a front rib 18 having the same outer diameter as the inner diameter of the large diameter portion 14 and on the opposite side thereof with a rear rib 19 having the same outer diameter as the inner diameter of the small diameter portion 15. On a state with the rear rib 19 and the front rib 18 of the piston 16 respectively inserted in the small diameter portion 15 and the large diameter portion 14, the solid cosmetic is charged in the cartridge 2 and the piston 16 is pushed by the pushrod 3 to advance the solid cosmetic.

Figure 5:
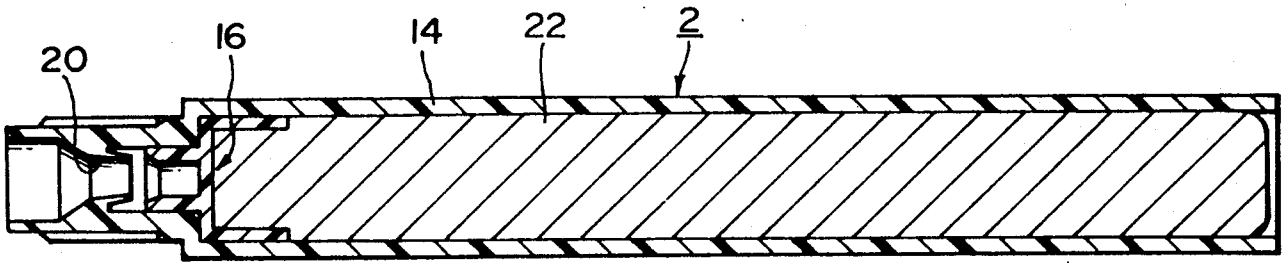
FIG. 5 is a vertical section of another mode of cartridge to that in FIG. 4.
Figure 6:
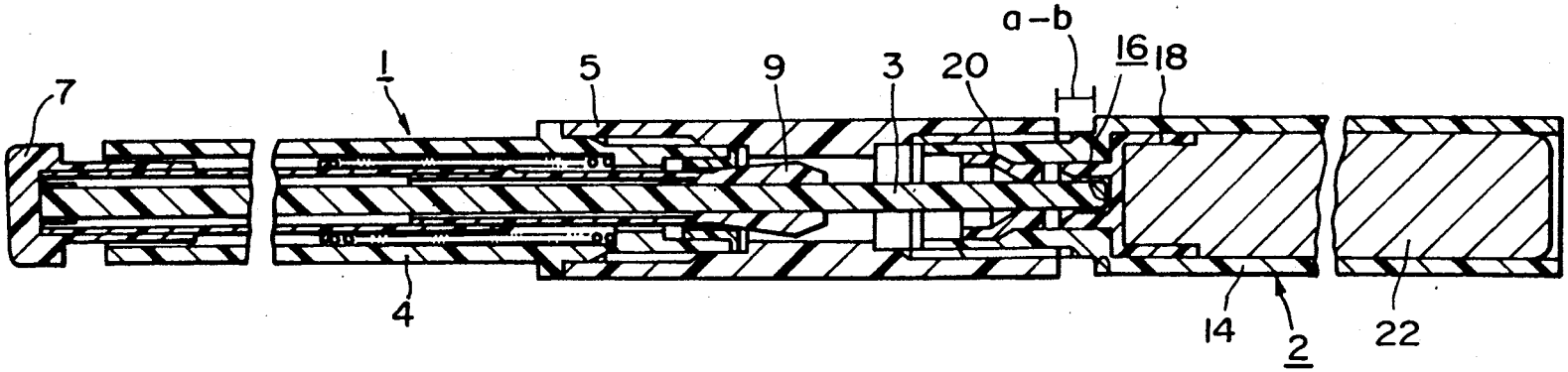
FIG. 6 is a vertical section of another embodiment of lipstick container than that in FIGS. 1–4.

At a position rearward the rear rib 19 of the small diameter portion 15 is provided a tubular pushrod holding member 20 made of rubber. The pushrod holding member 20 may be formed integrally with the cartridge 2 as shown in FIG. 5.

On the outer wall of the small diameter portion 15 is formed a screw thread 21 which cooperates with a corresponding screw thread formed on the frontward outer wall of the container main body 1 to engage with each other.

Now, the operation of the container will be described. In the embodiment shown in FIG. 1, with the coil spring 13 urging the pushrod housing pipe 6 rearward, the delivery chuck 9 is closed tight with its outer wall abutting against the delivery chuck fastener 11 and it fastens the pushrod 3 thereby bringing the entire container to a state of stability. Pushing or knocking the cap 7 advances the pushrod housing pipe 6 by one stroke. On first knocking, the cap 7 simultaneously pushes the pushrod 3 which advances by one stroke to push the piston 16 of the cartridge 2 and the advance of the piston 16 causes the solid cosmetic to be delivered through front end opening in an amount corresponding to said one-stroke.

When the cap 7 is released from knocking, both the pushrod housing pipe 6 and the delivery chuck 9 are forcibly urged rearward by the action of the coil spring 13, and the delivery chuck 9 is closed tight by the delivery chuck fastener 11 to fasten the pushrod 3. Then, the pushrod 3 is restrained from moving back by the pushrod holding member 20 and thus is maintained at the advanced position. Upon the next knocking operation, the pushrod 3 is moved forward by the delivery chuck 9 which is effectively holding the pushrod 3 and thus the solid cosmetic is delivered as described above. By only repeating these knocking operations, the solid cosmetic is successively delivered for use.

In case of necessity, when it is desired to draw in the solid cosmetic thus delivered, it can be pushed back while leaving the cap 7 in fully knocked condition. Then, as shown in FIG. 8, the delivery chuck 9 is released from the fastening by the delivery chuck fastener 11 and the front end of the delivery chuck 9 opens to free the pushrod 3 to allow the solid cosmetic to be easily pushed back.

Figure 7:
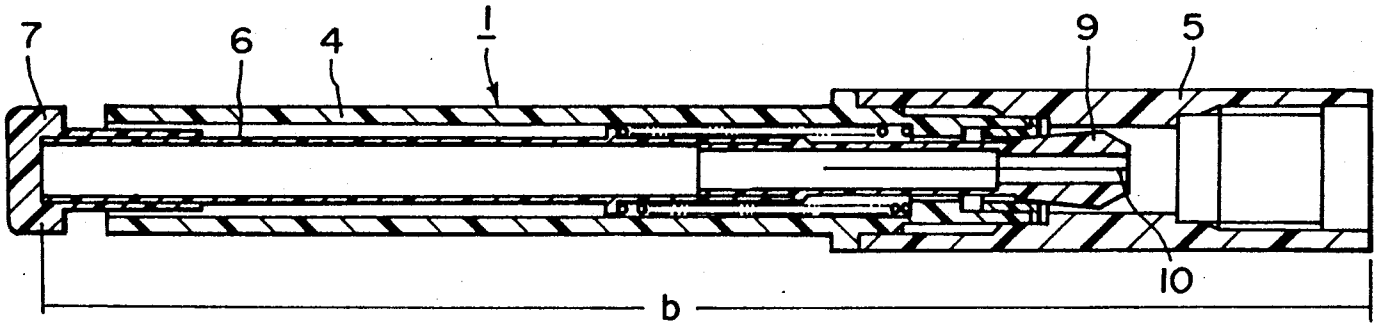
FIG. 7 is a vertical section of a container main body portion FIG. 6.
Figure 8:
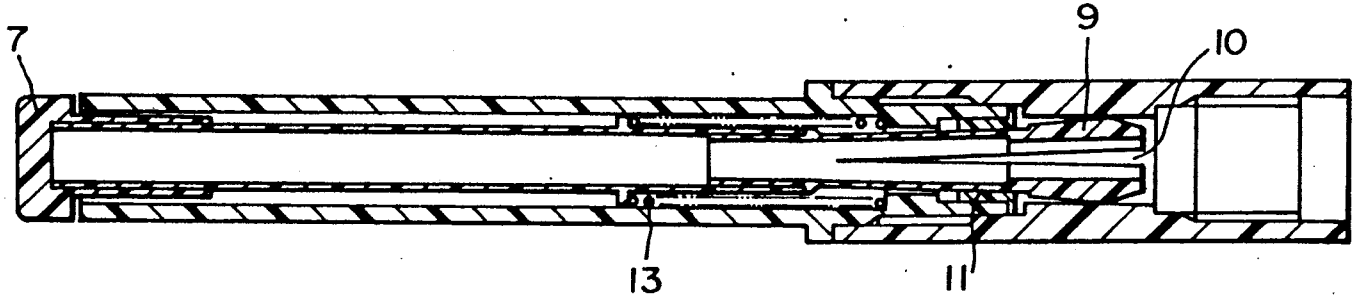
FIG. 8 illustrates a similar vertical section to FIG. 7, wherein a delivery chuck is moved forward.
Figure 9:
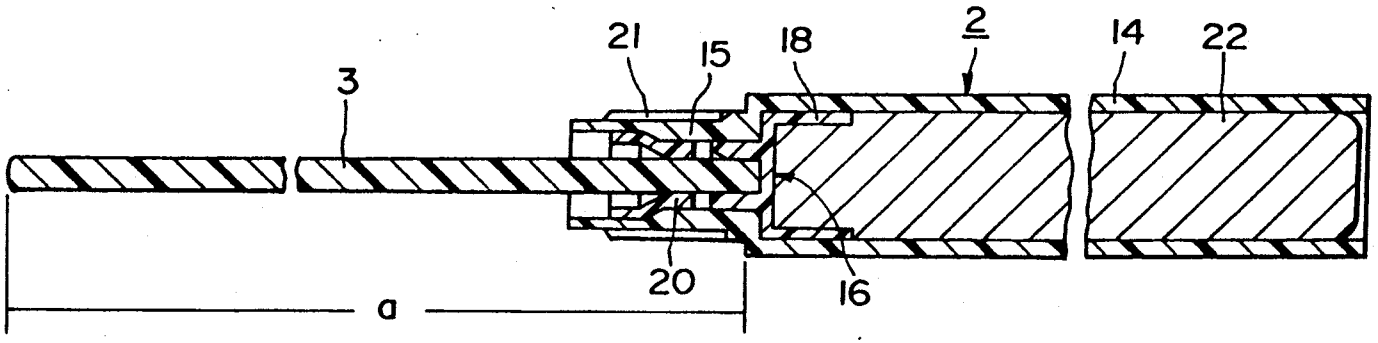
FIG. 9 is a vertical section partly cut away of the cartridge portion having the pushrod.

FIGS. 7–9 illustrate another embodiment of the lipstick container. Though the pushrod 3 is previously housed in the container main body 1 in the above embodiment, it is housed in this embodiment in the cartridge 2. Further, the length of the pushrod 3 is arranged a little longer than that in the above embodiment. Except for the above, structures and operation thereof are the same as those in the above embodiment.

In this embodiment, as shown in FIGS. 7, 8 and 9, the pushrod 3 is arranged so that, the length a from the rear end of the pushrod 3 to the rear end step 19 of the large diameter portion 14 is a little longer, for example by several mm, than the length b from the abutting face 23 of the cap 7 against the pushrod 3 to the front end of the container main body 1. Accordingly, when connecting the container main body 1 with the cartridge 2, the pushrod 3 obstructs the complete connection of the container main body 1 and the cartridge 2 and if they are forcibly connected, then the piston 16 is pushed forward by the length difference (a-b) to force; out the solid cosmetic. Since the force for forcibly connecting them is far stronger than that caused by the knocking operation of the cap 7, even if the solid cosmetic is stuck to the container, it can be delivered with its stuck condition easily broken off, thereby allowing the subsequent operation to be smoothly performed.

Figure 3:
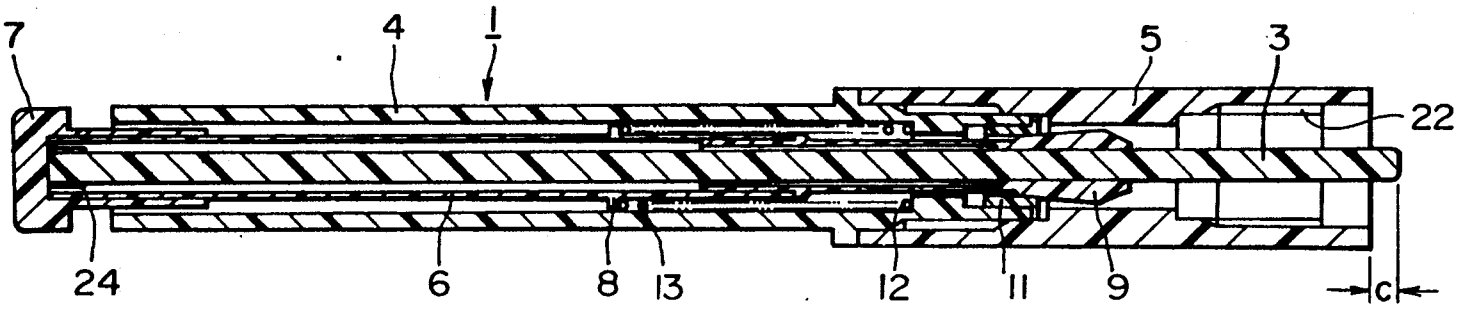
FIG. 3 is a vertical section of a container main body portion of FIG. 1.
Figure 4:
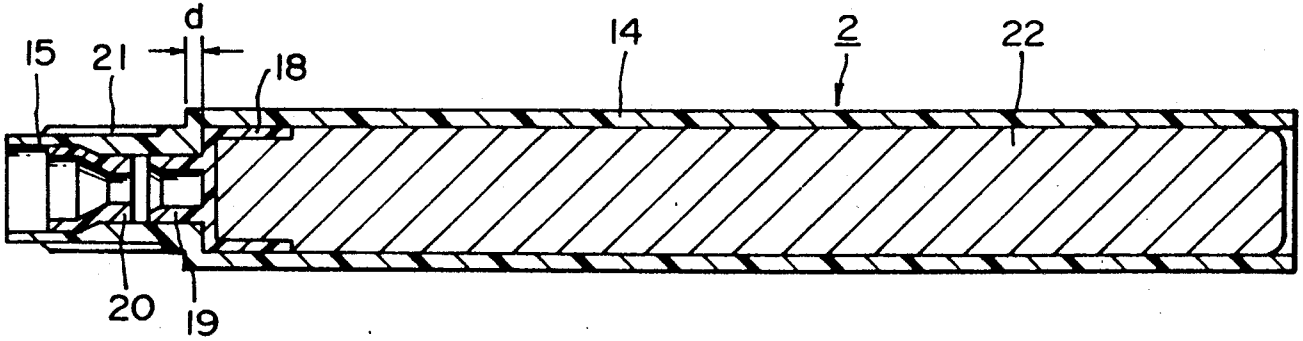
FIG. 4 is a vertical section of a cartridge portion of FIG. 3.

This arrangement can also be applied substantially in the same way to the container of the above first embodiment wherein the pushrod 3 is previously provided in the container main body 1. Namely, by designing the dimension such that the length c shown in FIG. 3 is somewhat longer than that of d shown in FIG. 4, the same function and effect can be obtained.

Figure 10:
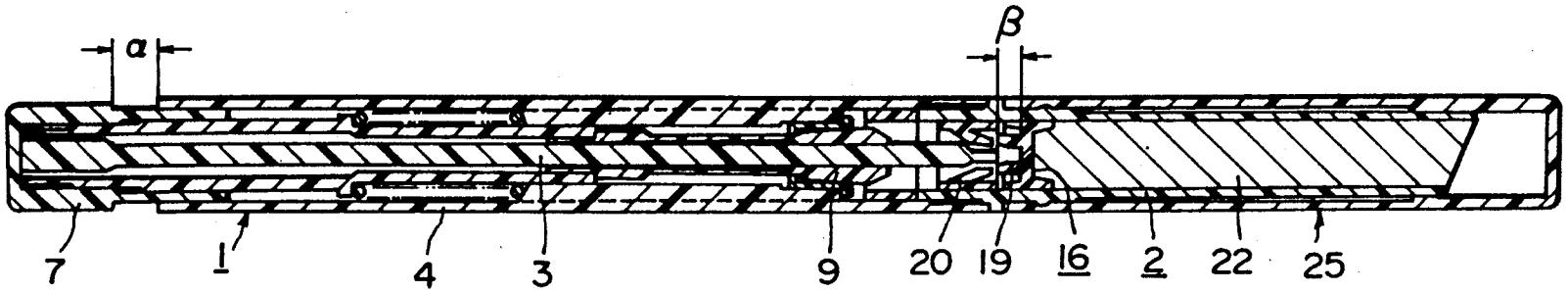
FIGS. 10 is a vertical section of lipstick container of a further embodiment.

FIG. 10 shows a further embodiment of the present invention. In this embodiment, as shown in FIG. 10, when the cartridge 2 is first connected to the container main body 1, the pushrod 3 in unknocked condition the piston 16 are not yet completely connected to leave a given gap $\beta$ between the front end of the pushrod 3 and the base portion of the piston 16. And, there is so designed that the gap $\beta$ is smaller than the space $\alpha$ between the step portion of the cap 7 and the rear end edge of the first shaft 4.

When the cap 7 is fully knocked to advance from the state of FIG. 10 until the front end thereof abuts against the rear end edge of the container main body 1, the front end of the pushrod 3 first abuts against the base portion of the piston 16 at the state the pushrod 3 has advanced by $\beta$ and further knocking of the cap 7 causes the piston 16 to further advance by the distance corresponding to the difference $(\alpha-\beta)$ thereby advancing the solid cosmetic together with the piston 16.

The container according to the present invention may be made of any conventional material. For example, all the parts except for the coil spring 13 may be made of synthetic resins, while the delivery chuck 9 and the delivery chuck fastener 11 may be made of metallic materials.

What is claimed is:

1. A knocking type solid cosmetics container which comprises:

a container main body 1 comprising a first tubular shaft 4 and a second tubular shaft 5;

a cylindrical pushrod housing pipe 6 inserted in the container main body 1, a rear end thereof being projected out with a given length from the container main body 1;

a delivery chuck 9 fixedly provided on a front end of the pushrod housing pipe 6, a frontward outer periphery portion of said chuck 9 being flared and said delivery chuck being formed with wedge-shaped slits widening frontward;

a pushrod 3 inserted passing through into the pushrod housing pipe 6 and the delivery chuck 9;

a tubular cartridge 2 having a pushrod holding member 20 therein;

a piston 16 contained axially movably in the cartridge 2 and having a pushrod receiving portion; and wherein said pushrod 3 is of such length that, when the container main body 1 and the cartridge 2 are first connected, the pushrod 3 is capable of pushing out the piston 16 by a given distance.

* * * * *